US006798382B2

(12) United States Patent
Edimo et al.

(10) Patent No.: US 6,798,382 B2
(45) Date of Patent: Sep. 28, 2004

(54) WIDENED BAND ANTENNA FOR MOBILE APPARATUS

(75) Inventors: Marc Edimo, Les Ulis (FR); Charles Ngounou Kouam, deceased, late of Les Ulis (FR), by Andre Marie Ngounou Yossa, legal representative

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/096,661

(22) Filed: Mar. 14, 2002

(65) Prior Publication Data

US 2003/0011521 A1 Jan. 16, 2003

(30) Foreign Application Priority Data

Mar. 15, 2001 (FR) ..... 01 03529

(51) Int. Cl.[7] ..... H01Q 1/38
(52) U.S. Cl. ..... 343/700 MS; 343/702
(58) Field of Search ..... 343/700 MS, 702, 343/770, 846; H01Q 1/38, 1/24

(56) References Cited

U.S. PATENT DOCUMENTS 6,407,715 B1 * 6/2002 Chen ..... 343/767
6,466,170 B2 * 10/2002 Zhou ..... 343/700 MS
6,529,168 B2 * 3/2003 Mikkola et al. ..... 343/702
2001/0048391 A1 * 12/2001 Annamaa et al. .... 343/700 MS
2002/0130816 A1 * 9/2002 Boyle ..... 343/702
2002/0140607 A1 * 10/2002 Zhou ..... 343/700 MS

FOREIGN PATENT DOCUMENTS

| | | |
|---|---|---|
| EP | 0 954 055 A1 | 11/1999 |
| EP | 1 018 779 A2 | 7/2000 |
| EP | 1 079 462 A2 | 2/2001 |
| FR | 2 772 518 A1 | 6/1999 |
| WO | WO 00/36700 | 6/2000 |

* cited by examiner

*Primary Examiner*—Hoangann Le
(74) *Attorney, Agent, or Firm*—Sughrue Mion, PLLC

(57) ABSTRACT

An antenna for radio communication apparatus is disclosed which includes a conductive patch having two sinuous slots, a ground, a short circuit connection connecting the patch to the ground, and a feed connection connected to the patch. The antenna has a radiation diagram including a first resonant band including frequencies from 1 950 MHz to 2 100 MHz and having a width greater than 20%. The antenna can operate in a frequency range covering the UMTS, PCS, DCS and possibly GSM bands. The same type of antenna can be used on many kinds of apparatus using different frequency bands, for example frequency bands varying from one country to another. Radio communication apparatus incorporating the above antenna is also disclosed.

15 Claims, 5 Drawing Sheets

WIDENED BAND ANTENNA FOR MOBILE APPARATUS

CROSS-REFERENCE TO RELATED APPLICATIONS

This application is based on French Patent Application No. 01 03 529 filed Mar. 15, 2001, the disclosure of which is hereby incorporated by reference thereto in its entirety, and the priority of which is hereby claimed under 35 U.S.C. §119.

BACKGROUND OF THE INVENTION

1. Field of the Invention

The invention relates to patch antennas. A patch antenna is typically used in a portion of the spectrum including radio frequencies and microwave frequencies and in particular in the GSM, DCS, PCS and UMTS bands.

2. Description of the Prior Art

Most antennas have one resonant frequency band. To transmit, when the antennas are excited in that resonant frequency band by means of a feed line, they support standing electromagnetic waves which are then coupled to electromagnetic waves radiated into space. To receive, the waves take the same forms but travel the above path in the opposite direction. Various antennas of the above type are known in the art.

Using microstrips on a plane as an antenna for transmitting signals is known in the art. Conductive patches are disposed on the upper face of a dielectric substrate and a conductive layer is placed on the lower face of the substrate. The conductive layer then serves as an electrical ground plane. The substrate is typically flat, rectangular and of constant thickness.

A multiband antenna is described in the document FR-A-2 772 518. It includes a flat patch disposed on the upper surface of a dielectric substrate. A ground layer is disposed on the lower surface of the dielectric substrate. This antenna is a quarter-wave antenna because a short circuit conductor disposed on an edge of the dielectric substrate connects the patch to the ground layer. This antenna includes connecting conductors for transmitting signals between the antenna and a signal processor.

A paper presented at the Davos AP 2000 conference by Ollikainen, Kivekas, Toropainen and Vainikainen discloses a multiband antenna including three patches placed on the upper surface of a Styrofoam (registered trademark) substrate. A ground layer is placed on the lower surface of the dielectric substrate. A first patch for the low band is joined to a second patch for the high band. The two patches therefore form a first two-band member having a zig-zag shape and including a feed. The two-band member includes a short circuit in the form of a junction with the ground plane. A third patch is positioned beside the second patch to obtain a double resonance in the high band, with a widened pass-band. The third patch includes a short circuit in the form of a junction with the ground.

The document "Novel meandered planar inverted F-antenna for triple frequency operation" published in Microwave and Optical Technology Letters, page 58, volume 27 No. 1, Oct. 5, 2000, describes a multiband antenna which has three patches placed in the same plane as a ground, in a "meandering" pattern. The three patches have a single feed.

The document U.S. Pat. No. 4,766,440 describes an antenna having two half-wave resonances. The antenna includes a rectangular patch in which the resonance paths are respectively established in the directions of the width and the length of the patch. A U-shaped slot is formed in the patch and does not reach the edges of the patch. The patch is connected to a coupling system including impedance converter means. Impedance conversion matches the coupling system to the various resonant frequencies used.

The document U.S. Pat. No. 4,771,291 describes an antenna including a patch. The patch includes localized short circuits and straight slots formed in the patch that do not reach the edges of the patch.

PCT application FR001586, not published at the date of filing this application, describes an antenna including a conductive patch with a ground, a feed connection, a short circuit connection connecting the patch to the ground, and a sinuous slot formed in the conductive patch.

The document IEEE Antennas and Propagation Society International Symposium Digest, Newport Beach, Jun. 18–23, 1995, pages 2124–2127, Boarg et al, "Dual Band Cavity-Backed Quarter-wave Patch Antenna" describes an antenna with quarter-wave resonances. A first resonance is defined by the dimensions and the characteristics of the patch and the substrate. A second resonance is obtained by using a matching system.

The above antennas have drawbacks. On the one hand, they necessitate large flat patches, incompatible with the small dimensions of the housings of mobile communication apparatus. On the other hand, they necessitate the fitting of capacitive loads to widen the pass-band, which adds to the cost and complexity of the antenna. Furthermore, they have a small bandwidth, in particular in the frequency band dedicated to the UMTS.

The above antennas are also costly and have a low send or receive efficiency. Nor is adjusting the resonant frequencies and the bandwidths of said frequencies a simple matter with these antennas.

There is therefore a need for an antenna that solves the above problems.

SUMMARY OF THE INVENTION

The invention therefore provides an antenna including a conductive patch including two sinuous slots, a ground, a short circuit connection connecting the patch to the ground, and a feed connection connected to the patch and having a radiation diagram including a primary resonant band including frequencies from 1 950 MHz to 2 100 MHz and having a width greater than 20%.

In one variant the radiation diagram includes a secondary resonant band including frequencies from 890 MHz to 950 MHz and having a width greater than 10%.

In another variant the patch has a substantially polygonal shape.

In a further variant the slots open onto the same edge of the patch.

In a still further variant the short circuit connection is connected to the patch via the edge onto which the slots open or an adjacent edge.

In one variant the feed connection is connected to the patch via the edge onto which the slots open or an adjacent edge.

In another variant the feed connection and the short circuit connection are disposed on respective opposite sides of at least one of the slots.

In a further variant the slots have contours of different length.

The invention also provides an antenna in which the difference in the lengths of the contours of the slots is from 5% to 30%.

In one variant the ground is a conductive surface parallel to the surface of the patch.

In another variant the distance between the slots is from 5 mm to 15 mm.

In a further variant the patch is formed of a metal film.

In another variant the slots have substantially the same shape and the same orientation.

In a further variant the slots have substantially the same shape and opposite orientations.

The invention also provides radio communication apparatus including an antenna according to the invention and having a thickness less than 20 mm, a length less than 120 mm, and a width less than 50 mm.

Other features and advantages of the present invention will become apparent on reading the following description of embodiments of the invention, which description is given by way of example and with reference to the accompanying drawings.

DETAILED DESCRIPTION OF THE PREFERRED EMBODIMENTS

The invention proposes an antenna in which two sinuous slots are coupled to a conductive patch. The antenna has a radiation diagram with a resonant band having a width greater than 20%. The resonant band typically covers several transmission frequency bands, for example the DCS, PCS and UMTS bands.

The antenna is described in what follows when sending, i.e. converting an electrical current into an electromagnetic field. It is obvious to the person skilled in the art that the operation of the antenna is similar when receiving, i.e. when converting an electromagnetic field into an electrical current.

In the following description, to determine the percentage width of a resonant frequency band, the cut-off frequencies at the −6 dB point are determined on the curve of the measured reflection coefficient of the antenna. The range of resonant frequencies is determined by subtracting the lower cut-off frequency from the upper cut-off frequency. The center frequency of the resonant band, which is the median frequency between the cut-off frequencies, is then determined. The percentage width of the resonant frequency band is the ratio of the resonant frequency range to the center frequency of the band multiplied by 100.

Figure 1:
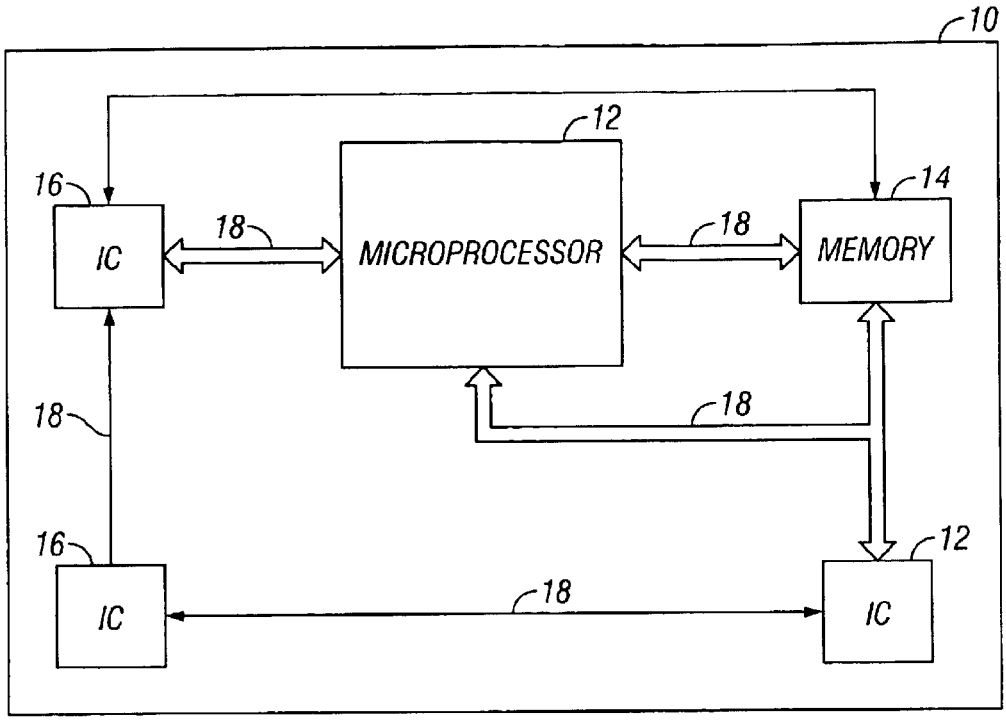
FIG. 1 (Prior Art)
FIG. 1 is a perspective view of a first embodiment of an antenna according to the invention.

FIG. 1 is a perspective view of one embodiment of an antenna according to the invention. The antenna 1 includes a conductive patch 2 in which a first slot 3 and a second slot 4 are formed. The conductive patch has a feed connection 5 and a short circuit connection 6 connected to a ground 7. A substrate 8 is disposed between the patch and the ground 7. The feed connection 5 is connected to a signal generator and processor 9 which outputs a signal in the form of an electrical current.

The patch is preferably substantially polygonal. The patch shown is rectangular but the invention is not limited to this kind of shape, of course.

Figure 2:
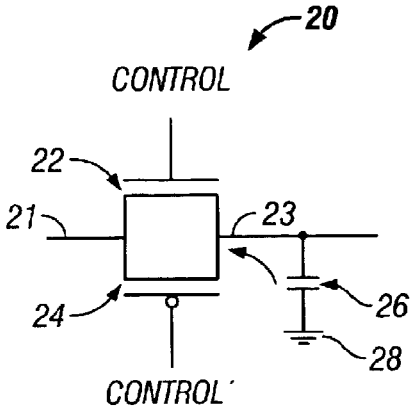
FIG. 2 (Prior Art)
FIG. 2 is a plan view of a variant antenna.

This embodiment of the antenna has a resonant frequency band that is referred to hereinafter as the "secondary" band. It also has a resonant frequency band that is referred to as the "primary" band and is explained in more detail later. The secondary resonant band is obtained by coupling the slots 3 and 4. The slots 3 and 4 open onto the same edge 25 of the patch. As shown in FIG. 2, the slots delimit a median part 10, a first end or tail 11, and a second end or tail 12 in the patch. These three parts are connected by an edge 26 of the patch. The patch 2 is fed by the feed connection 5. The feed connection 5 is disposed at the first end 11, on the edge 25 onto which the slots 3 and 4 open. The short circuit connection 6 is disposed at the second end 12, on the edge 25. Feeding the patch generates a first electrical current starting from the feed connection 5, circumventing the slot 3 and returning via the median part 10 to the edge 25. On passing through the median part 10, the electrical current generates an electromagnetic coupling effect which excites the slot 4. A second electrical current is then generated. This second electrical current starts from the short circuit connection 6, circumvents the slot 4 and returns via the median part 10 to the edge 25. The first and second electrical currents are therefore added together in the median part 10.

The electrical currents generate strong electromagnetic radiation in the areas 21, 22 and 23 shown in chain-dotted line in FIG. 2. The radiation has two resonant frequencies, defined by the dimensions of the respective slots 3 and 4. The wavelength of the electromagnetic field corresponding to the resonance of each slot is defined by the length of the contour of the slot. The resonances are quarter-wave resonances because the short circuit connection 6 between the patch 2 and the ground 7 imposes an electrical field node. Accordingly, the length of the electrical path is of the order of $\lambda/4$, where $\lambda$ is the wavelength is air or in a vacuum. Because the conductive patch is short circuited by the short circuit connection 6, the dimensions of the antenna can therefore be reduced for a given resonant frequency. The short circuit connection 6 preferably has a sufficiently low impedance to impose this electrical field node.

The secondary frequency band is therefore formed of two strongly coupled resonances respectively generated by the first and second slots. The resonant frequencies are not superposed and are sufficiently close together to generate a widened resonant frequency band. For this it is desirable for the slots to have contours of slightly different length. The difference in the length of the contours is preferably from 5% to 30%. The resonant frequencies are then separate, so that they are not superposed, and sufficiently close together to widen the resonant frequency band. Appropriate dimensions of the patch and the contour of the slots generate a secondary frequency band including the GSM band and/or the E-GSM band and more specifically frequencies from 890 MHz to 950 MHz. The band formed in this way has a width greater than 10%. What is more, the efficiency in this band is greater than 70%.

The speed of propagation of electrical currents is close to the speed of light. Accordingly, the current flow is approximately as if the patch were fed by the feed connection 5 and by the short circuit connection 6. The path of the electrical currents is similar to the path in a structure having two isolated patches fairly close together and each having a slot and a feed connection.

The primary resonant frequency band also uses the coupling of the slots 3 and 4. An electrical current is generated and crosses the first end 11 of the feed connection to the edge 26. This electrical current generates an induced current which flows through the median part from the edge 25 to the edge 26. This latter electrical current also generates an induced current that passes through the second end from the short circuit connection to the edge 26.

The electrical currents are concentrated at the edge 26 and generate strong electromagnetic radiation in the area 24 shown in chain-dotted line in FIG. 2. The radiation therefore includes at least two resonant frequencies that are defined mainly by the dimensions of the patch. The length of the patch determines the wavelengths at which resonance occurs. These resonances are quarter-wave resonances because of the short circuit connection 6 between the patch 2 and the ground 7. Accordingly, the length of the electrical path is of the order of $\lambda/4$.

Thus the primary frequency band is formed of at least two coupled resonances which are also influenced by the geometry and the length of the contour of the slots. The resonant frequencies in this band are higher than in the secondary band because the path of the electrical current is shorter. The resonant frequencies are not superposed and are sufficiently close together to generate a widened resonant frequency band, for which it is equally desirable for the slots to have contours of slightly different length. Appropriate dimensions of the patch and the contour of the slots generate a primary frequency band including the UMTS band and the PCS band, and more specifically frequencies from 1 950 MHz to 2 100 MHz. The band formed in this way has a width greater than 20%. What is more, the efficiency in this band is greater than 70%.

Figure 3:
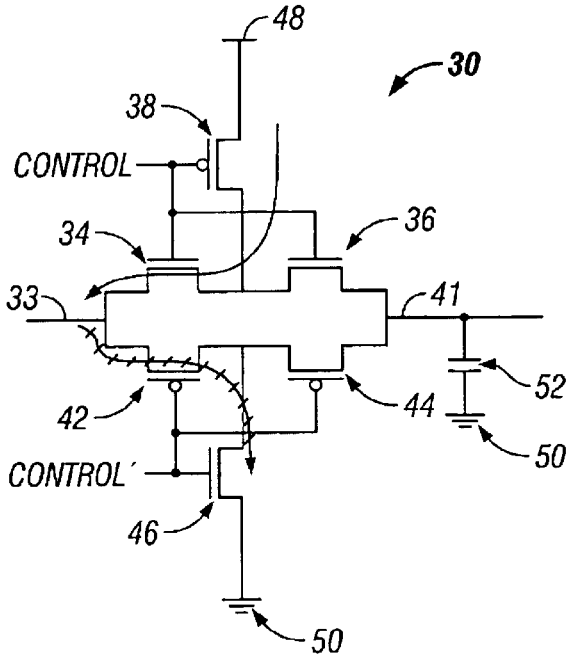
FIG. 3 is a plan view of possible dispositions of short circuit and feed connections.

The short circuit connection 6 and the feed connection 5 are preferably disposed on the same edge of the conductive patch. This improves the coupling of the resonant modes. A widened bandwidth is then obtained. Generally speaking, the feed connection and the short circuit connection are preferably disposed on the edge 25 or on an adjacent edge, as shown in FIG. 3. Thus the short circuit connection is preferably placed in an area 27. The feed connection is preferably placed in an area 28. The orientation of the contour of the slots can of course be the opposite of that shown, with a similar position of the short circuit connection and the feed connection.

The resonant frequencies and the matching can be modified by modifying the relative position of the feed connection relative to the short circuit connection. To do this, the connections 5 and 6 are placed at appropriately chosen locations. To improve the gain and facilitate fabrication of the antenna, it is also preferable to place the feed connection and/or the short circuit connection on the edges of the patch. For example, the matching is improved by disposing the feed connection on an edge of the patch. This achieves a better [lacuna] of the antenna and therefore a reduced reflection coefficient, especially in the primary resonant frequency band.

The feed connection and the short circuit connection are preferably on either side of one of the slots, i.e. a line drawn between the feed connection and the short circuit connection crosses a slot.

In a variant, the resonant frequencies of the slots can be coupled to increase the amplitude of the radiated electromagnetic field. Slots having very similar contour lengths are used for this purpose.

Figure 4:
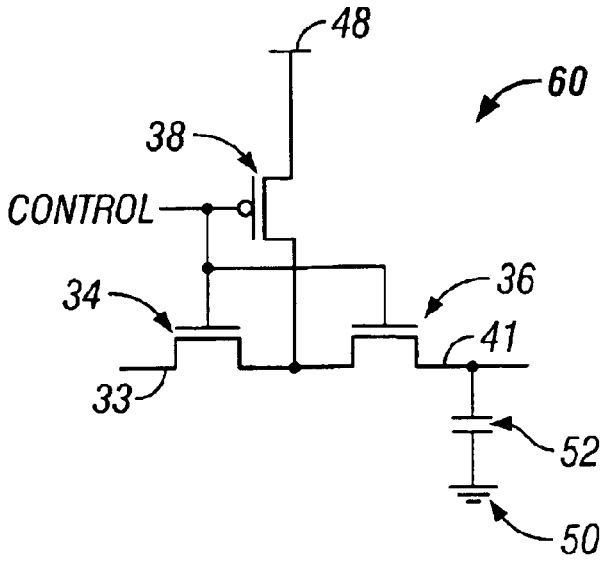
FIG. 4 is a diagrammatic representation of slot patterns.

The slots are preferably sinuous, departing from a straight line segment shape in order to increase the length of their contour. A sinuous contour deforms the path of the electrical current. FIG. 4 shows examples of appropriate sinuous slot shapes. The shape of the slots can be close to a V, a U, a circular arc or an incompletely closed rectangle, for example. Accordingly, for a given slot contour length, slots can be used occupying less space in the conductive patch. Thus the dimensions of the antenna can be reduced. The slots preferably have contours of similar shape.

It is preferable to use sinuous slots made up of straight line segments. This facilitates fabrication because of the simple contour. Adjustment of the antenna frequencies is also facilitated.

Figure 5:
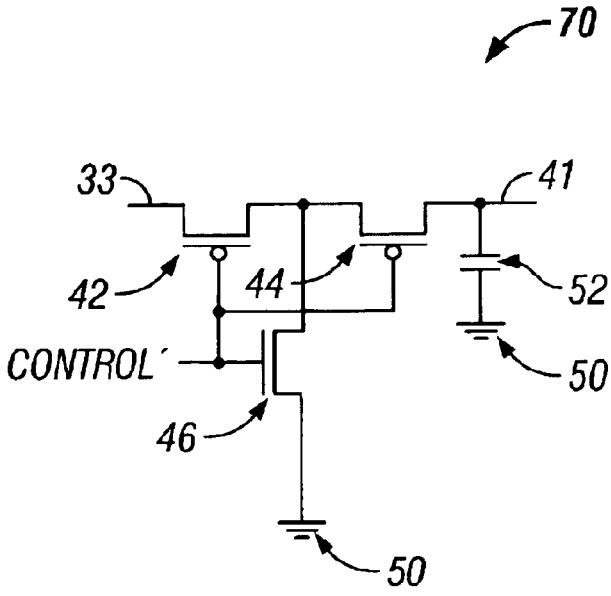
FIG. 5 is a diagrammatic representation of a preferred slot pattern.

FIG. 5 shows a particular form of sinuous slot which significantly reduces the dimensions of the patch and the antenna. The slot is made up of straight line segments forming a spiral. This reduces the antenna dimensions by approximately 20% compared to an antenna with V-shaped slots.

Figure 9:
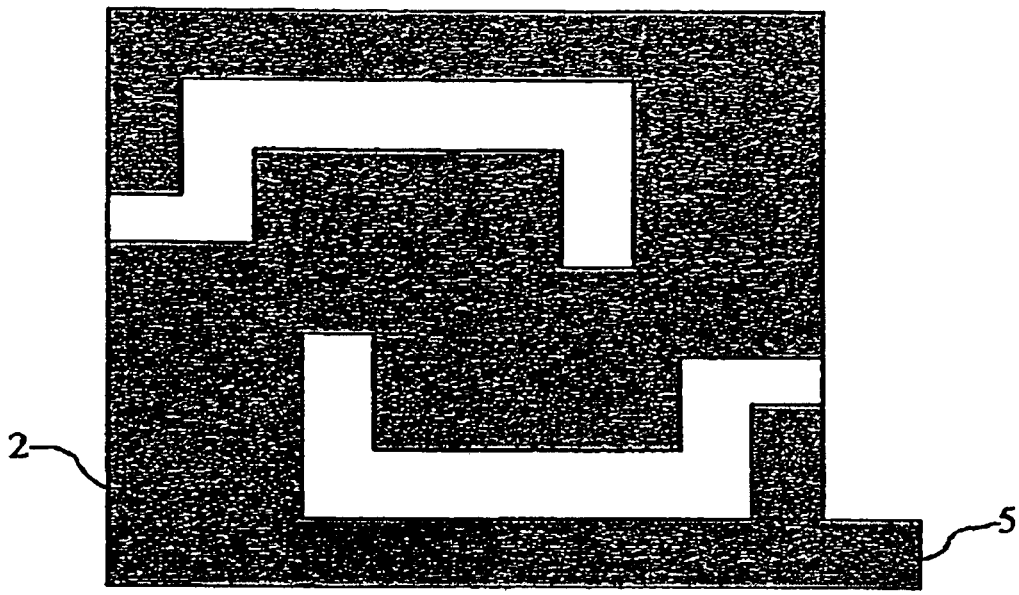
FIG. 9 is a diagrammatic representation of slot patterns in which the slots have opposite orientations.
Figure 1:
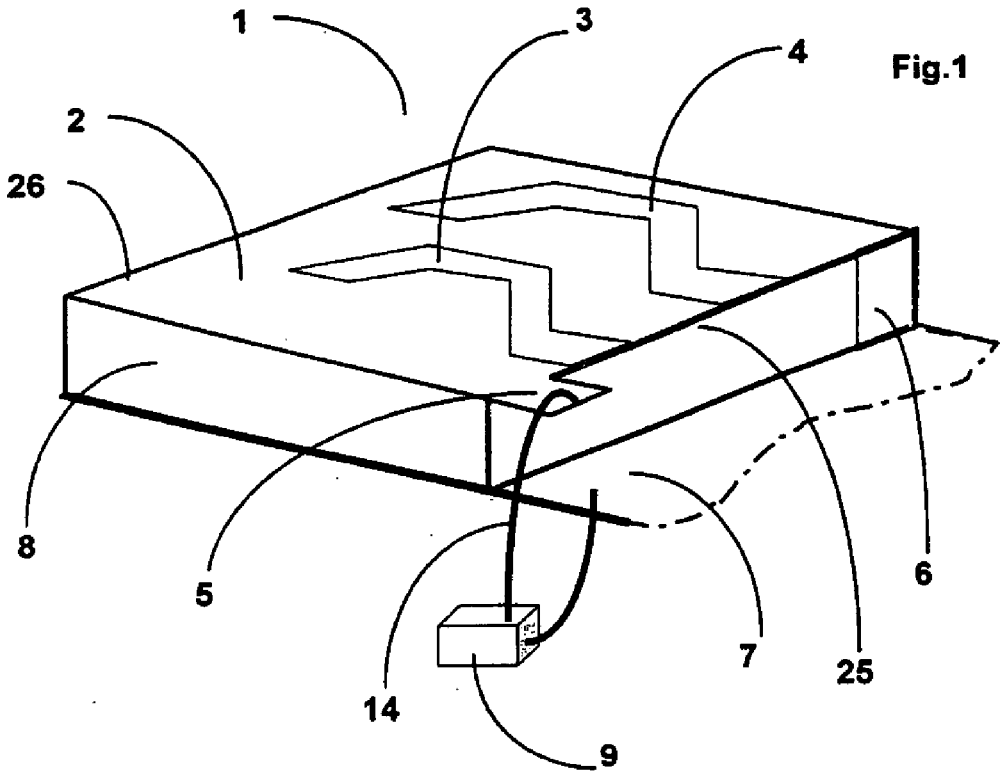
Figure 2:
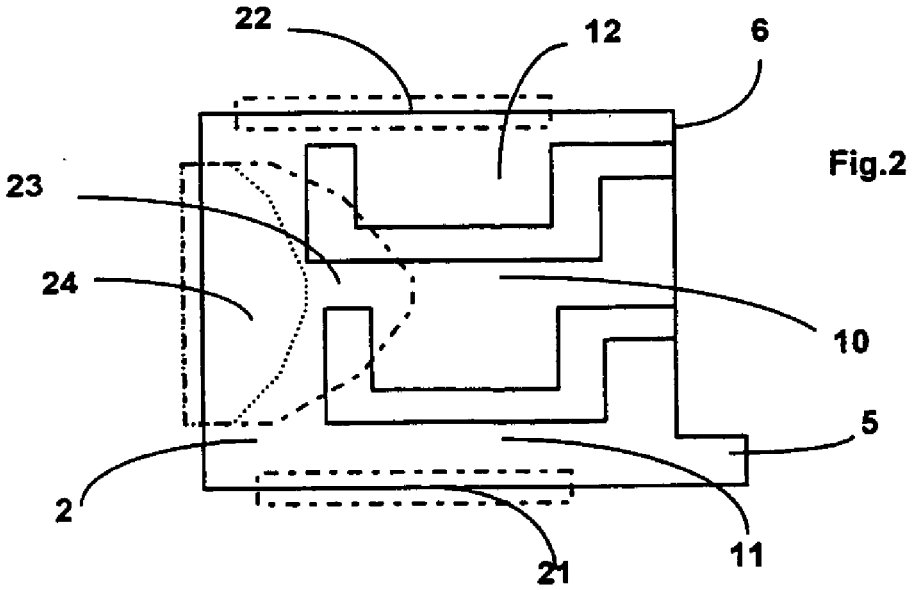
Figure 3:
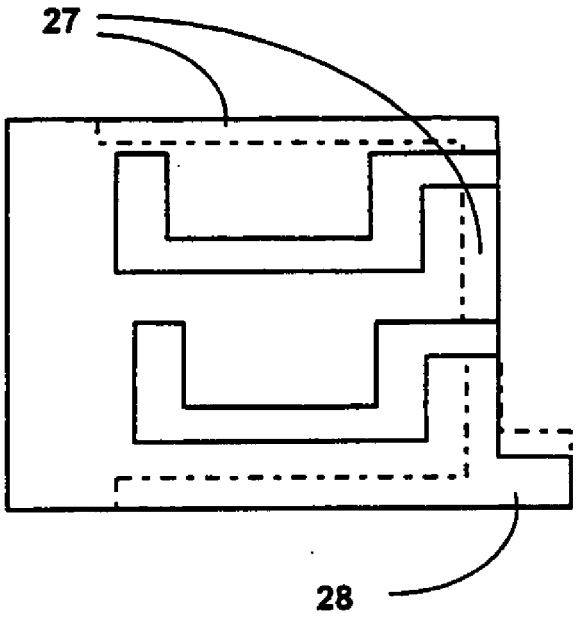
Figure 4:
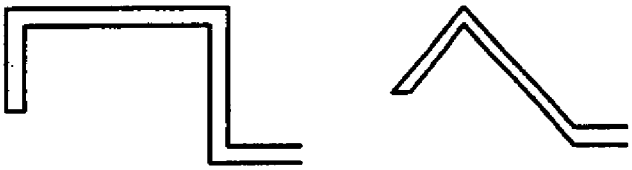
Figure 5:
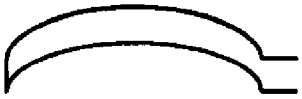
Figure 5:
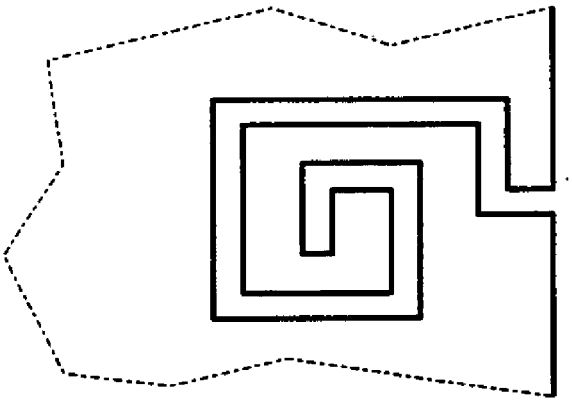

The relative orientation of the contours of the slots modifies the characteristics of the antenna. Accordingly, if the slots of contours with the same orientation, as shown in FIGS. 1 to 3, the width of the coupling frequency band is increased. The same orientation of the contours adds the electrical current in the median part 10, which is then higher and generates and increased induced current around the slot 4. This increases the amplitude of radiation and widens the pass-band. If the contours of the slots have opposite orientations, as shown in FIG. 9, the radiation has improved symmetry, but to the detriment of the pass-band and the amplitude of radiation.

Modifying the distance between the slots modifies the coupling between them. Accordingly, increasing the distance between the slots reduces the coupling but increases the width of the pass-bands. The distance between the slots, i.e. the distance between the closest together two points on respective slots is preferably greater than 5 mm. The widening of the resonant frequency band is particularly sensitive in the case of the primary resonant frequency band. If the distance between the slots is increased beyond 15 mm, the resonant frequencies become separate and not coupled, and no longer form a resonant band.

It is possible to produce the ground 7 in the form of a metal plate. In this case it is desirable to use a ground 7 formed of a plane metal conductive surface parallel to the conductive patch 2. A ground of this kind limits the power of radiation intercepted by the user of the device. In the embodiment shown in FIG. 1, the ground 7 and the conductive patch 2 are separated by a substrate 8.

The substrate 8 is preferably of constant thickness. A substrate thickness is preferably chosen which tunes the frequencies and widens the pass-bands. Increasing the thickness of the substrate widens the resonant frequency bands. The thickness of the substrate 8 is limited by the dimensions of the radio communication apparatus. To enable the use of a ground return tongue, for example, a substrate 8 is preferably used with one edge at the same level as or set back relative to an edge of the conductive patch 2. This simplifies the assembly of the antenna. To improve the gain, it is also desirable to produce this kind of substrate with a material whose relative permittivity is close to that of air, preferably less than 2. A material is preferably chosen having a very low dissipation factor, to be more specific a dissipation factor less than $10^{-3}$. It is thus possible to make the substrate 8 from polymethylacrylimide foam or a laminate based on a fluoropolymer such as PTFE. A foam of this kind also provides good mechanical strength.

The feed connection 5 is coupled to a transmitter or to a signal processor 9 by a connecting line 14. This connection can be made by a coaxial cable, for example. In this case the inner conductor of the coaxial cable can be used to connect the patch to the processor, for example. In this case the outer conductor of the coaxial cable connects the ground 7 to the processor. To prevent unwanted reflection of signals between the feed connection and the transmitter, for example, it is preferable to have a uniform impedance along the connecting line. For this, it is useful for the feed connection 5 to be a tongue starting from the patch and extended to form the connecting line. The feed connection can be a tongue formed in the conductive patch.

A processor is preferably used that is able to operate at predetermined working frequencies close to the usable resonant frequencies of the antenna, for example working frequencies in pass-bands centered on the resonant frequencies. A composite processor can be used, which includes a plurality of processor units, each processor unit being tuned permanently to the working frequencies. It is equally possible to use a processor including a processor unit than can be tuned to the various working frequencies.

What is more, to have an optimum gain, i.e. an optimum ratio between the power of the signal radiated by the antenna and the power of the output signal of the transmitter, it is desirable for the input impedance of the antenna to be equal to the output impedance of the transmitter or the signal processor 9. The input impedance is preferably 50 ohms, to obtain minimum losses.

The connection 6 is preferably formed of a conductive tongue extending over an edge of the substrate 8. In this case it is equally possible to produce the short circuit connection in the form of a tongue projecting from the conductive patch.

What is more, the conductive patch can also include a tongue at the level of the short circuit portion of the patch. To this end a tongue projects from an edge of the short circuit portion and is preferably aligned with the conductive patch. Flexing the tongue modifies the resonant frequencies of the antenna. The tongue also widens the resonance pass-bands of the antenna. The tongue can be 10 mm long and 6 mm wide. The tongue is preferably on one of the ends or tails of the patch.

Figure 6:
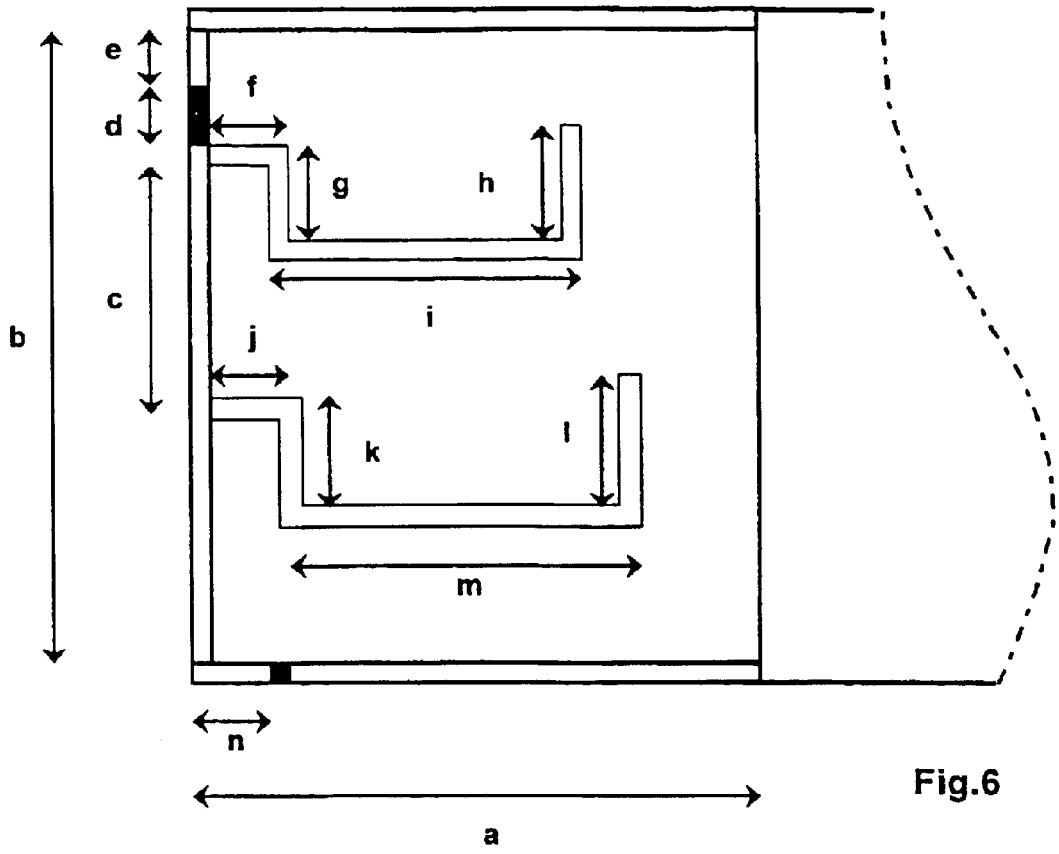
FIG. 6 is a detailed plan view of one example of an antenna.
Figure 7:
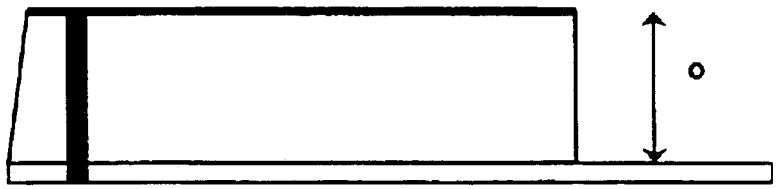
FIG. 7 is a side view of the FIG. 6 antenna.

FIGS. 6 and 7 show an antenna in accordance with the invention. The antenna has the following dimensions:

| | | | |
|---|---|---|---|
| a = 35 mm | b = 42 mm | c = 10 mm | d = 3 mm |
| e = 3.5 mm | f = 3.6 mm | g = 5.4 mm | h = 7 mm |
| i = 23.2 mm | j = 3 mm | k = 8.6 mm | l = 10.6 mm |
| m = 26.5 mm | n = 3 mm | o = 6 mm. | |

The patch is 100 $\mu$m thick and is made of copper.

The feed connection is a 1 mm wide tongue. The short circuit connection is a 3 mm wide tongue. The slot is 1 mm wide. The substrate is a polymethacrylimide foam having a 1 mm taper on three of its faces. The ground is a PCB 44 mm by 110 mm.

Figure 8:
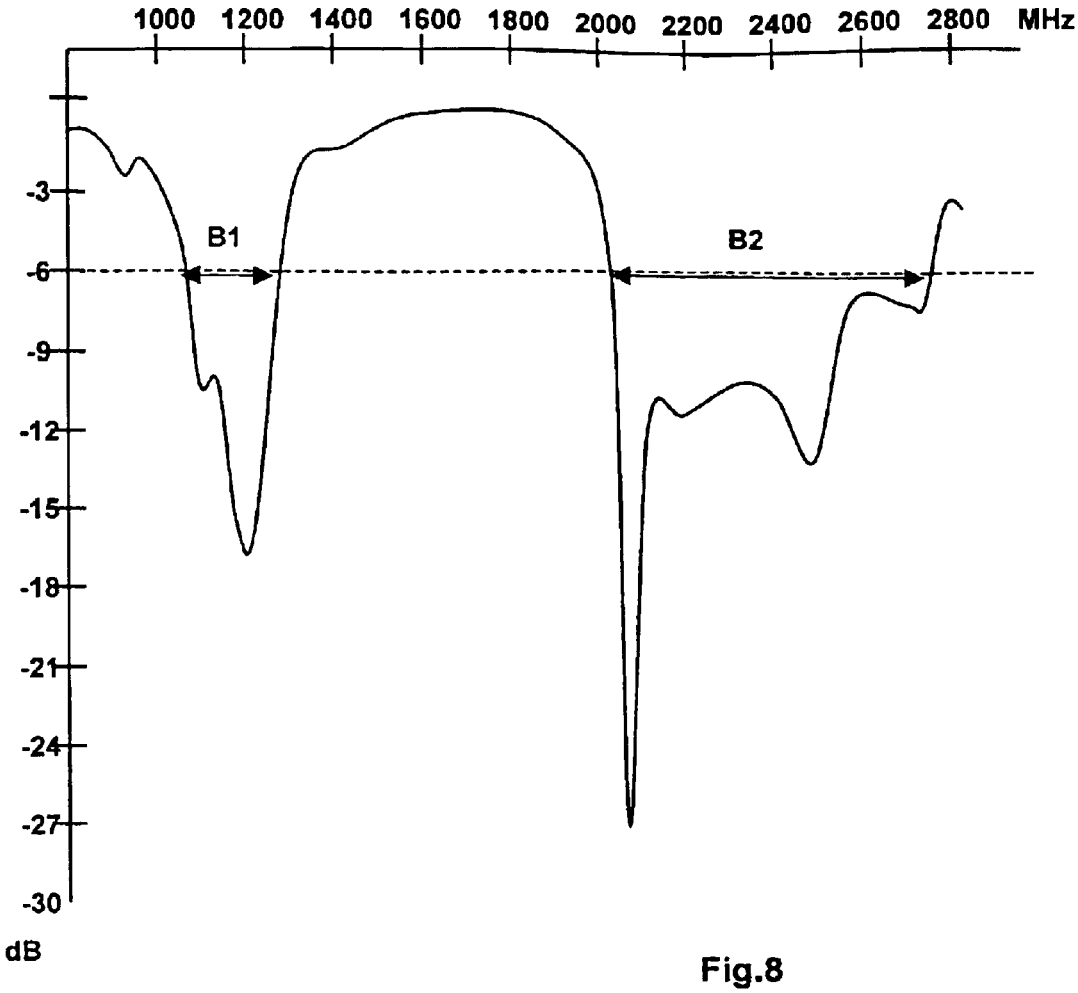
FIG. 8 is a diagram of the reflection frequency spectrum of the antenna shown in FIGS. 6 and 7.

FIG. 8 shows an input reflection frequency spectrum measured for the antenna shown in FIGS. 6 and 7. A low reflection of the antenna at a given frequency corresponds to a resonance of the antenna. Two frequencies are complementary to form a widened secondary resonant frequency band B1 from 1 020 MHz to 1 260 MHz. The center frequency is 1 145 MHz. For this band the bandwidth is therefore 21%. Resonant frequencies are also complementary to form a widened primary resonant frequency band B2 from 2 005 MHz to 2 740 MHz. The center frequency is 2 350 MHz. The width of this band is approximately 30%. Using appropriate adjustments of the antenna previously described, the frequency bands are easy to adapt to cover the GSM, DCS, PCS and UMTS. Placing the antenna in the housing of a mobile telephone generally lowers the center frequency of the resonant frequency bands, maintaining a constant percentage bandwidth. The frequency bands are thus just offset. The presence of a battery, an earpiece, a microphone, electronic components and the supporting card also modifies the center frequency of a resonant frequency band. Thus placing this antenna in the housing of a standard telephone yields frequency bands B1 and B2 respectively including the E-GSM and DCS-PCS-UMTS bands. The E-GSM band has a width of 8.7%. The band from the DCS to the UMTS has a width of 25%. The characteristics of the antenna are therefore more than sufficient to cover these bands.

The invention further concerns radio communication apparatus including an antenna as previously described. The antenna can be disposed inside a protective housing of the apparatus.

The invention also concerns an antenna fabrication method which includes a step of cutting two sinuous slots in a metal film.

A variant of the method includes a step of cutting a short circuit tongue. Another variant of the method includes a step of cutting a feed connection. A further variant of the method includes a step of cutting an electrical connection over a portion of the width of the metal film.

Of course, the present invention is not limited to the examples and embodiments described and shown, but lends itself to many variants that will be evident to the person skilled in the art.

Accordingly, although a plane conductive patch has been described until now, it is equally possible to use a conductive patch that is curved, for example to espouse the shape of a mobile telephone housing. A conductive patch with a shape different from the rectangle shown can also be used, such as a patch in the shape of a disk. It is also possible to bend the feed and short circuit tongues if necessary.

There is claimed:

1. An antenna including a conductive patch including two sinuous slots, a ground, a short circuit connection connecting said patch to said ground, and a feed connection connected to said patczh wherein the patch has a substantiafly polygonal shape and the slots open on the same edge of the patch and the radiation diagram includes a primary resonant band including frequencies from 1950 MHz to 2 100 MHz and having a width greater than 20%; and wherein the short circuit connection is connected to the patch via the edge onto which the slots open or an adiacent edge.

2. The antenna claimed in claim 1, wherein the radiation diagram includes a secondary resonant band including frequencies from 890 MHz to 950 MHz and having a width greater than 10%.

3. The antenna claimed in claim 1, wherein the feed connection is connected to the patch via the edge onto which the slots open or an adjacent edge.

4. The antenna claimed in claim 3, wherein the feed connection and the short circuit conunction are disposed on respective opposite sides of at least one of the slots.

5. The antenna claimed in claim in claim 1, wherein the feed connection and the short circuit connection are diaposed on respective opposite sides of at least one of the slots.

6. The antenna claimed in claim 1, wherein the slots have contours of different length.

7. The antenna claimed in claim 6, wherein the difference in the lengths of the contours of the slots is from 5% to 30%.

8. The antenna claimed in claim 1, wherein the ground is a conductive surface parallel to the surface of the patch.

9. The antenna olaimd in claim 1, wherein the distance between the slots is from 5 mm to 15 mm.

10. The anteuxia claimed in claim 1, wherein the patch is formed of a metal film.

11. The antenna claimed in claim 1, wherein the slots have substantially the same shape and the same orientation.

12. The antenna claimed in claim 1, wherein the slots have substantially the same shape and opposite orientations.

13. A radio communication apparatus including an antenna, comprising:

a conductive patch including two sinuous slots, aground, a short circuit conitection connecting said patch to said ground, and a feed connection connected to said patoix wherein the patch has a substantially polygonal shape and the slots open on the same edge of the patch end the radiation diagram includes a primary resonant band including frequencies from 1 950 MHz to 2 100 MHz and having a width greater than 20%; and wherein the radio communication apparatus has a thickness less than 20 mm, a length less than 120 mm and a width less than 50 mm; and wherein the short circuit connection is connected to the path via the edge onto which the slots open or an adjacent edge.

14. The radio communication apparatus of claim 13, wherein the radiation diagram includes a secondary resonant band including frequencies from 890 MHz to 950 MHz and having a width greater than 10%.

15. The radio communication apparatus of claim 14, wherein the primary resonant band is between 2005 MHz and 2740 MHz and the secondary resonant band is between 1020 MHz and 1260 MHz.

* * * * *

UNITED STATES PATENT AND TRADEMARK OFFICE

CERTIFICATE OF CORRECTION

PATENT NO. : 6,798,382 B2 
DATED : September 28, 2004
INVENTOR(S) : Marc Edimo, Charles Ngounou Kouam and Christophe Grangeat It is certified that error appears in the above-identified patent and that said Letters Patent is hereby corrected as shown below:

Please replace the figure on the title page with a copy of correct Fig. 1 attached.

Title page,
Item [75], Inventors, please amend as follows:
-- [75] Inventors: Marc Edimo, Les Ulis (FR); Charles Ngounou Kouam, deceased, late of Les Ulis (FR), by Andre Marie Ngounou Yossa, legal representative; Christophe Grangeat, Sevres (FR) --

Drawings,
Please replace Figures 1-5 with the attached Figures 1-5.

Signed and Sealed this

Ninth Day of August, 2005

JON W. DUDAS
*Director of the United States Patent and Trademark Office*

(12) United States Patent
Edimo et al.

(10) Patent No.: US 6,798,382 B2
(45) Date of Patent: Sep. 28, 2004

(54) WIDENED BAND ANTENNA FOR MOBILE APPARATUS

(75) Inventors: Marc Edimo, Les Ulis (FR); Charles Ngounou Kouam, deceased, late of Les Ulis (FR), by Andre Marie Ngounou Yossa, legal representative

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/096,661

(22) Filed: Mar. 14, 2002

(65) Prior Publication Data

US 2003/0011521 A1 Jan. 16, 2003

(30) Foreign Application Priority Data

Mar. 15, 2001 (FR) ..... 01 03529

(51) Int. Cl.[7] ..... H01Q 1/38
(52) U.S. Cl. ..... 343/700 MS; 343/702
(58) Field of Search ..... 343/700 MS, 702, 343/770, 846; H01Q 1/38, 1/24

(56) References Cited

U.S. PATENT DOCUMENTS 6,407,715 B1 * 6/2002 Chen ..... 343/767
6,466,170 B2 * 10/2002 Zhou ..... 343/700 MS
6,529,168 B2 * 3/2003 Mikkola et al. ..... 343/702
2001/0048391 A1 * 12/2001 Annamaa et al. .... 343/700 MS
2002/0130816 A1 * 9/2002 Boyle ..... 343/702
2002/0140607 A1 * 10/2002 Zhou ..... 343/700 MS

FOREIGN PATENT DOCUMENTS

| | | |
|---|---|---|
| EP | 0 954 055 A1 | 11/1999 |
| EP | 1 018 779 A2 | 7/2000 |
| EP | 1 079 462 A2 | 2/2001 |
| FR | 2 772 518 A1 | 6/1999 |
| WO | WO 00/36700 | 6/2000 |

* cited by examiner

*Primary Examiner*—Hoangann Le
(74) *Attorney, Agent, or Firm*—Sughrue Mion, PLLC

(57) ABSTRACT

An antenna for radio communication apparatus is disclosed which includes a conductive patch having two sinuous slots, a ground, a short circuit connection connecting the patch to the ground, and a feed connection connected to the patch. The antenna has a radiation diagram including a first resonant band including frequencies from 1 950 MHz to 2 100 MHz and having a width greater than 20%. The antenna can operate in a frequency range covering the UMTS, PCS, DCS and possibly GSM bands. The same type of antenna can be used on many kinds of apparatus using different frequency bands, for example frequency bands varying from one country to another. Radio communication apparatus incorporating the above antenna is also disclosed.

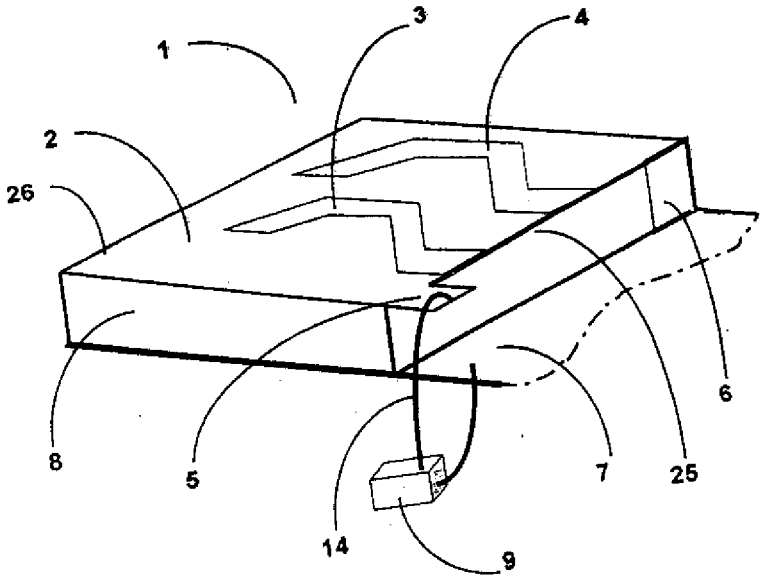

15 Claims, 5 Drawing Sheets